US006652986B2

(12) United States Patent
Peldszus et al.

(10) Patent No.: US 6,652,986 B2
(45) Date of Patent: Nov. 25, 2003

(54) METHOD FOR PRESERVING WOOD AND PRESERVED WOOD OBTAINED IN ACCORDANCE WITH THE METHOD

(75) Inventors: Rüdiger Peldszus, Hasselroth (DE); Egon Walzer, Maintal (DE); Martin Bauer, Freigericht (DE); Norbert Steiner, Alzenau (DE); Michael Del Grosso, Hamilton (NL)

(73) Assignee: Degussa AG, Düsseldorf (DE)

( * ) Notice: Subject to any disclaimer, the term of this patent is extended or adjusted under 35 U.S.C. 154(b) by 77 days.

(21) Appl. No.: 09/795,969

(22) Filed: Mar. 1, 2001

(65) Prior Publication Data

US 2001/0044034 A1 Nov. 22, 2001

(30) Foreign Application Priority Data

Mar. 3, 2000 (DE) ..... 100 10 125

(51) Int. Cl.[7] ..... B27K 3/22; B27K 3/42; B27K 3/52

(52) U.S. Cl. ..... 428/541; 428/907

(58) Field of Search ..... 427/440; 428/541, 428/907; 106/18.33

(56) References Cited

U.S. PATENT DOCUMENTS 4,038,086 A * 7/1977 Clarke et al. ..... 106/18.31
4,061,500 A * 12/1977 Hager ..... 106/18
5,703,103 A * 12/1997 Heuer et al. ..... 514/365
5,888,526 A * 3/1999 Tsubai et al. ..... 424/402

OTHER PUBLICATIONS

German Industrial Standard DIN 113, Sep. 1996.

German Industrial Standard DIN 84, Jan. 1997.

* cited by examiner

*Primary Examiner*—Ramsey Zacharia
(74) *Attorney, Agent, or Firm*—Smith, Gambrell & Russell, LLP

(57) ABSTRACT

A method for preserving wood that includes impregnating the wood with a wood preservative agent based on one or more compounds of at least one metal of the 1$^{st}$ and/or 2$^{nd}$ subgroups of the periodic system and fixing the metal(s) for purposes of reducing the danger of leaching. The wood is (i) impregnated with a preservative containing a water-soluble zinc compound or (ii) wood that has already been impregnated with a zinc-free preservative or one that contains at least one metal compound of the 1$^{st}$ and/or 2$^{nd}$ subgroups is impregnated with a second preservative that contains at least one water-soluble zinc compound, and wood impregnated in accordance with (i) or (ii) is impregnated with an aqueous solution of a salt of trimercapto-s-triazine (TMT), dithiocarbamate or trithiocarbonate.

5 Claims, No Drawings

METHOD FOR PRESERVING WOOD AND PRESERVED WOOD OBTAINED IN ACCORDANCE WITH THE METHOD

INTRODUCTION AND BACKGROUND

The present invention relates to a method for preservation of wood using a wood preservative based on one or more compounds of at least one metal of the $1^{st}$ and/or $2^{nd}$ subgroup of the periodic system, where the preservative is at least partially fixed in the wood for purposes of reducing the danger of leaching. In another aspect, the invention relates to the preserved wood with reduced danger of leaching that can be obtained in accordance with the method of the invention.

The life span of wood used for construction purposes, telegraph poles, railroad ties and the like, can, as is well known, be increased by treating it with a preservative. Such preservative agents have a toxic effect on the fungi and insects that damage wood. The preservatives are in many cases inorganic metal compounds such as compounds of chromium, copper, and arsenic. More recently, attempts are being made to avoid the use of Cr- and As-containing preservatives, because of their toxicity. Water-soluble compounds of these metals are introduced at least into the surface regions of the wood by means of substantially known impregnation processes. The initially water-soluble metal compounds are converted at least partially into sparingly soluble compounds through oxidative processes and by interaction between the metal compounds and components of the wood. This process progresses slowly and incompletely. Through intensive contact with water, metals are partly leached out, and the preservative effect diminishes at the same time.

Impregnating wood exclusively with a copper salt solution and undertaking an at least partial fixation of the copper by subsequent heat treatment using steam or hot air, for example, is also known. This process has high energy requirements and reduces the capacity of the treatment plant for wood preservation to a considerable extent.

Accordingly, an object of this invention is to improve methods for preserving wood, and particularly to reduce the danger of leaching.

SUMMARY OF THE INVENTION

The above and other objects of the invention can be achieved by impregnating wood with a wood preservative based on metal compounds of metal selected from the $1^{st}$ and/or $2^{nd}$ subgroups of the Periodic Table of Elements (Groups IB and IIB) and then subsequently fixing. In accordance with a feature of the invention, it should be ensured that the fungicidal effect of the metal compounds is not adversely affected by the fixing step. A feature of the invention is aimed at not only effectively reducing leaching of metal from wood treated with a copper-containing preservative by means of a post-treatment, but also of increasing the fungicidal effect.

It is known that many metals, including those selected from the group consisting of the $1^{st}$ and $2^{nd}$ subgroups of the periodic system, form sparingly soluble salts with trimercapto-s-triazine, hereinafter called TMT. Accordingly, in wastewater treatment technology heavy metal compounds are precipitated by a treatment with a water-soluble salt of TMT. The principle of formation of sparingly soluble salts of heavy metals of the $1^{st}$ and $2^{nd}$ subgroups with TMT can also be applied to the fixing of heavy metals introduced into wood by means of an impregnation through treatment with an aqueous solution of a TMT salt. Salt formation of a corresponding kind is also possible with a dithiocarbamate or trithiocarbonate.

It was also found that fixing Cu with TMT is possible, but the fungicidal effect toward certain fungi is largely lost, and thus the wood is left open to attack by microorganisms. However, it was surprisingly found that through the presence of zinc in a preservative, where the zinc can even have been introduced through a separate impregnation, the fungicidal effect of this combination (Cu+Zn) and of other zinc-containing combinations with another metal of the $1^{st}$ or $2^{nd}$ subgroup of the periodic system is not reduced, but rather is increased.

A method was found for preserving wood that includes impregnating the wood with a wood preservative agent based on one or more compounds of at least one metal selected from the group consisting of the $1^{st}$ subgroup (Group IB) of the Periodic Table of Elements, the $2^{nd}$ subgroup (Group IIB) of the Periodic Table of Elements and mixtures thereof, and then fixing the metal for purposes of reducing the danger of leaching. The method is carried out by (i) impregnating the wood with a preservative containing a water-soluble zinc compound, or (ii) impregnating wood that has been previously impregnated with a zinc-free preservative that contains at least one metal compound of the $1^{st}$ and/or $2^{nd}$ subgroup with a second preservative that contains at least one water-soluble zinc compound. The wood impregnated in accordance with either (i) or (ii) is then impregnated with a water-soluble solution of a salt of trimercapto-s-triazine (TMT), a water-soluble dithiocarbamate or trithiocarbonate. In accordance with preferred embodiments, the use of a copper- and zinc-containing preservative in the impregnation step and a post-treatment with a solution of a TMT salt is particularly preferred. Besides Cu and Zn salts, Ag and Hg salts in particular are suitable as preservative agents. The further embodiments concern TMT-containing systems, but they can also be extended to other organosulfur compounds.

DETAILED DESCRIPTION OF INVENTION

According to a first embodiment the preservative to be used contains a water-soluble zinc compound. In the second impregnation with a water-soluble TMT salt that follows the first impregnation a sparingly soluble Zn-TMT salt forms. Due to this, the danger of leaching is reduced.

Preferably, the preservative contains, in addition to a zinc compound, one or more compounds of one or more other metals of the $1^{st}$ and/or $2^{nd}$ subgroup of the periodic system. It is especially preferred that the preservative contain a copper and a zinc compound, such as a water soluble salt. Expediently, these are the sulfates, chlorides, nitrates and acetates of the said metals.

According to another embodiment of the invention, wood that has already been preserved with a compound of a metal of the $1^{st}$ and/or $2^{nd}$ subgroup of the periodic system, except for zinc, can be impregnated with a solution of a zinc salt for purposes of introducing zinc. This additional impregnation step is conducted so that zinc is introduced at least into the surface regions of the wood.

The one- or two-step impregnation for purposes of introducing the metal compounds into the wood is carried out in a substantially known way. The term "impregnation" is understood to mean treatments under normal pressure, excess pressure and preferably reduced pressure. The term includes immersion methods, where the wood is put into a solution containing the preservative as well as methods involving spraying the preservative onto the wood and letting the preservative work itself into the wood. With the latter embodiment only preservation in the surface regions is usually achieved.

The metal compounds introduced into the wood by one- or two-step impregnation are fixed by impregnation with a solution of a TMT salt. Here, too, the term "impregnation" as used herein includes the embodiments mentioned above.

Suitable water-soluble salts of TMT are lithium, sodium, potassium and ammonium salts. As trivalent mercapto compounds the TMT salts can have one, two or three cations. The sodium salts of TMT are particularly preferred; in view of solubility, the di- and especially the trisodium TMT salts are used. These water solvable salts are well known and any suitable one may be used in accordance with the present invention.

The concentration of the TMT salt in the solution used for impregnation can lie in a wide range, in particular in the range from 0.01 wt % up to the saturation concentration of the salt. A usage concentration in the range of 0.05 to 5 wt % is preferred and one in the range of 0.1 to 1 wt % is especially preferred.

The usage concentration of the solution used in the preservation step (the $1^{st}$ impregnation step), which solution contains at least one metal compound, preferably a zinc compound, and a compound of another metal of the $1^{st}$ or $2^{nd}$ subgroup of the periodic system, especially a copper compound, lies in a substantially known range. Expediently this means a metal concentration each in the range from 0.01 to 10 wt %, preferably 0.1 to 5 wt %.

It was found, as shown in the examples, that in the case of wood impregnated beforehand with one or more generic metal salts and treated by an impregnation with the TMT salt does undergo a certain change of color caused by a leaching treatment, but the fungicidal effect toward the test fungus *Tyromyces placenta* is completely retained.

As follows from the comparison examples (experiments without TMT treatment) the preservative effect toward the test fungus *Tyromyces placenta* is lost in a corresponding leaching of preserved wood treated with Cu, Zn or Cu+Zn but not with a TMT salt. After leaching, wood treated with Cu shows a slight reduction of the fungicidal effect toward the test fungus *Coniophora puteana*, while wood preserved with Zn shows a clear reduction, and wood preserved with Cu+Zn shows a moderate reduction.

Wood treated with a Cu compound and a TMT salt (Cu/TMT) has little resistance toward the test fungus *Coniophora puteana*, and a clear loss of weight occurs. In contrast, Zn/TMT-treated wood shows clearly higher resistance. Surprisingly, the combination Cu+Zn/TMT shows a particularly high resistance toward this test fungus. Treatment of wood preserved with Cu and Zn using a TMT salt thus leads to a surprisingly increase of the resistance of the wood to fungal attack.

EXAMPLES

The investigation was conducted with the active agent copper sulfate ($CuSO_4.5H_2O$) and zinc sulfate ($ZnSO_4.7H_2O$) and a combination of these salts, which were introduced into the kiln dried wood as 4% aqueous solutions in a vacuum process in accordance with EN 113:1996 (incorporated herein by reference) ($1^{st}$ immersion). The test material consisted of pine sapwood pieces measuring $30\times30\times5_{axial}$ $mm^3$, with 6 parallel tests being carried out for each test variation. After a 4-week fixing and drying period half of the samples were again kilned, impregnated in a second vacuum process (in accordance with EN 113:1996) with a TMT 15 solution diluted to 3 wt % TMT-Na3 (TMT is a trade name for a 15 wt % aqueous solution of trimercapto-s-triazine trisodium salt) ($2^{nd}$ immersion) and then dried for 14 days under indoor conditions. The samples were weighed before and after each immersion in order to determine the uptake of the immersion agent. In each case half of the samples impregnated only with copper and/or with zinc sulfate and half of the samples impregnated in the two-step process were subjected to a leaching test in accordance with EN 84:1997 (in each case 18 samples, 400 ml water, 8 changes of water) the samples were sterilized two times for 20 minutes at 100° C. in flowing steam.

The brown rot fungi *Coniophora puteana* BAM Ebw. 15 and *Tyromyces placenta FPRL* 280, which are considered to be copper-tolerant, were selected as the test fungi and grown in Petri dishes (Ø87 mm) with 20 ml malt agar as nutrient medium (4% malt, 2% agar). In each case two samples were put onto stainless steel rings that were about 3 mm high in a dish that was completely overgrown with the test fungus and exposed to fungal attack for 6 weeks (at 20° C. and 70% relative air humidity). After removing the adhering mycelium, the samples were weighed, kilned and again weighed, in order to determined the removed moisture and the loss of weight. To monitor the fungal activity, pine sapwood samples that had not been treated at all and ones that had been leached with water were subjected to the fungal attack.

The changes of weight caused by the various immersions were measured on six parallel samples in each case: Table 1 shows the average values. The protective agent uptake achieved in immersion 1 corresponds to the values that are usually achieved in an EN 113 test with larger sample format ($1.5\times2.5\times5_{axial}$ $cm^3$). The immersion agent uptake in the subsequent immersion with the TMT salt solution was not changed in the case of the zinc sulfate-immersed samples and was changed little in the case of the copper sulfate-immersed or copper/zinc sulfate-immersed samples.

TABLE 1

Immersion solution uptake (in g of immersion solution per sample) and protective agent uptake (in $kg/m^3$) in each case as the average value of 6 samples of this group.

| | | Immersion 1 (metal salt) | | Immersion 2 (TMT salt) | |
|---|---|---|---|---|---|
| No. | Immersion Agent | Immersion solution uptake (g) | Protective agent uptake[2)] ($kg/m^3$) | Immersion solution uptake (g) | Protective agent uptake[2)] ($kg/m^3$) |
| 1 | $CuSO_4$ (4 wt %[1)]) | 3,496 | 31.1 | | |
| 2 | ZnSO4 (4 wt %[1)]) | 3,447 | 30.6 | | |
| 3 | CuSO4 + ($ZnSO_4$)) | 3,546 | 63.0 | | |
| 4 | $CuSO_4$/ TMT-Salt[3)] | 3,478 | 30.9 | 3.411 | 22.7 |
| 5 | ZnSO4/ TMT-Salt[3)] | 3,453 | 30.7 | 3,460 | 23.1 |
| 6 | CuSO4 + $ZnSO_4$/ TMT-Salt[3)] | 3,580 | 63.6 | 3,397 | 22.6 |

[1)]expressed as $CuSO_4.5\ H_2O$ or $ZnSO_4.7\ H_2O$ or the sum thereof
[2)]expressed as TMT $Na_3$
[3)]metal salt concentration by analogy with No. 1–3, TMT salt concentration 3 wt % TMT $Na_3$ The Zn/TMT samples after immersion were yellow-brown, and the contact surfaces with other samples remained wood colored. Cu/TMT samples after immersion showed an olive green surface and rust brown contact surfaces. Samples that contained both zinc and copper sulfate (Cu+Zn/TMT) were colored dark olive and likewise had rust brown contact surfaces.

The leaching treatment took place in accordance with the European Norm EN 84:1997. Changes of color that diminished with each change of water occurred here.

The results of the tests of the preserving effect compared to the two test fungi are summarized in Tables 2 (control values) and 3 (weight losses and wood moisture content after fungal attack).

TABLE 2

Change of weight (average values of 6 parallel tests in each case) of samples not exposed to fungal attack, which were taken into account as correction values in calculating the loss of weight caused by the fungus.

| Immersion Agent | Without leaching weight loss (%) | With leaching weight loss (%) |
|---|---|---|
| None | 0.2 | 1.4 |
| $CuSO_4$ | −0.5 | 5.6 |
| $ZnSO_4$ | −2.2 | 2.7 |
| $CuSO_4$ +$ZnSO_4$ | −5.4 | 5.7 |
| $CuSO_4$/TMT | −5.2 | 3.1 |
| $ZnSO_4$/TMT | −6.4 | 2.0 |
| $CuSO_4$ + $ZnSO_4$/TMT | −8.2- | −0.9 |

TABLE 3

Corrected weight loss (average value) and average ultimate moisture content of test samples exposed to fungal attack.

| | Without leaching | | With leaching | |
|---|---|---|---|---|
| Immersion agent | Moisture content (%) | Corrected weight loss (%) | Moisture content (%) | Corrected weight loss (%) |
| *Coniophora puteana* | | | | |
| None | 74.8 | 34.0 | 78.1 | 29.7 |
| $CuSO_4$ | 111.7 | 34.0 | 37.2 | 0.9 |
| $ZnSO_4$ | 97.1 | 0.4 | 45.3 | 9.9 |
| $CuSO_4$ + $ZnSO_4$ | 130.6 | 0.2 | 39.3 | 1.5 |
| $CuSO_4$/TMT | 132.7 | 0.7 | 66.7 | 4.5 |
| $ZnSO_4$/TMT | 138.0 | 0.7 | 61.1 | 2.5 |
| $CuSO_4$ + $ZnSO_4$/TMT | 121.2 | 0.7 | 49.8 | 0* |
| *Tyromyces placenta* | | | | |
| None | 55.2 | 19.5 | 54.7 | 15.6 |
| $CuSO_4$ | 75.8 | 0.1 | 51.3 | 9.7 |
| $ZnSO_4$ | 77.5 | 1.0 | 54.9 | 11.7 |
| $CuSO_4$ + $ZnSO_4$ | 112.6 | 1.0 | 58.2 | 10.6 |
| $CuSO_4$/TMT | 116.8 | 0* | 36.0 | 0* |
| $ZnSO_4$/TMT | 104.7 | 0* | 34.2 | 0* |
| $CuSO_4$ + $ZnSO_4$/TMT | 97.3 | 0* | 33.9 | 0* |

*Weight increases of test samples resulting after correction (= negative weight loss values) are evaluated as absence of fungal attack and are indicated in the table with the value "0."

The tests yielded the following results:

*C. puteana* produced weight losses between 28% and 38% on untreated, i.e., unpreserved, control samples (with and without leaching) and thus showed wood decomposition behavior that should be seen as normal for the selected test conditions. The same thing is true for the weight losses produced on untreated pine wood for *T. placenta*, which were between 11 and 25%.

None of the samples that were not exposed to leaching could be attacked either by *C. puteana* or *T. placenta*.

Samples preserved with Cu, Zn or Cu+Zn showed quite different results after the leaching treatment with and without the second immersion with a TMT salt. *T. placenta* attacked the Cu, Zn and Cu/Zn samples after the leaching treatment and in these samples produced weight losses of over 7%. The samples that had additionally been impregnated with TMT (Cu/TMT, Zn/TMT and Cu/Zn/TMT) were not degraded by *T. placenta* after the leaching treatment. The treatment with a TMT salt lead to an improved preserving effect.

*C. puteana* produced very low weight losses on Cu-containing samples, clear weight losses on Zn-containing samples and low weight losses on Cu+Zn-containing samples after the leaching treatment. The samples that were additionally impregnated with a TMT salt solution were strongly attacked by *C. puteana* after leaching in the case of Cu/TMT samples (weight losses up to 12.3%, Ø=4.5%), while in contrast the Zn/TMT samples showed only slight and the Cu+Zn/TMT samples did not show any weight loss. While the resistance to an attack by an *C. puteana* increased after leaching treatment in the case of the Zn/TMT and the Cu+Zn/TMT samples due to TMT salt impregnation, the samples containing copper sulfate and TMT (Cu/TMT) were clearly attacked more strongly by *C. puteana* (weight losses up to 12.3%) than were the TMT-free Cu samples (weight losses up to 2.4%).

While impregnation of the preserved wood with a dilute solution of a TMT salt clearly increased the efficacy of the sulfates after leaching treatment in the case of the test fungus T placenta, in the case of the very copper toleration test fungus *C. puteana* this can be said only for the zinc-containing samples (Zn/TMT and Cu+Zn/TMT). The reason for this behavior is not known at the present time; lack of uniformity in the uptake of the immersion agent can be excluded as the cause.

Further variations and modifications of the foregoing will be apparent to those skilled in the art and are intended to be encompassed by the claims appended hereto.

German priority application 100 10 125.9 filed Mar. 3, 2000 is relied on and incorporated herein by reference.

What is claimed is:

1. Preserved wood having a reduced danger of leaching of the preservative agent, having an amount of a zinc compound introduced into the wood using a water soluble zinc compound and a salt of trimercapto-s-triazine as a fixing agent.

2. Preserved wood according to claim 1 which contains a TMT-salt of zinc in the outermost zones of the wood.

3. Preserved wood with reduced danger of leaching of the preservative agent, having been treated with an amount of a zinc compound and a compound of another metal of the 1st or 2nd subgroup of the Periodic Table, where zinc is situated at least in the outermost zones of the wood, and subsequently impregnated with an aqueous solution of a salt of trimercapto-s-triazine.

4. Preserved wood according to claim 3 which contains a TMT-salt of zinc and TMT-salt of copper in the outermost zones of the wood.

5. Preserved wood produced (i) by impregnating wood with a preservative containing a water-soluble zinc compound or (ii) treating wood which has been previously impregnated with a zinc-free preservative containing at least one metal compound of the first and/or second subgroup, of the Periodic Table by further impregnating with a second preservative that contains at least one water soluble zinc compound, and further impregnating the wood in accordance with (i) or (ii) with a fixing agent which is an aqueous soluble solution of a salt of trimercapto-s-triazine.

* * * * *